United States Patent [19]

Bricher et al.

[11] 4,295,274

[45] Oct. 20, 1981

[54] SCARIFYING MACHINE

[75] Inventors: Charles W. Bricher, St. Paul; Ferdinand J. Herpers, Minnetonka, both of Minn.

[73] Assignee: Tennant Company, Minneapolis, Minn.

[21] Appl. No.: 928,685

[22] Filed: Jul. 27, 1978

[51] Int. Cl.[3] ..... B26B 27/00; B26B 25/00

[52] U.S. Cl. ..... 30/347; 30/172; 30/276; 15/93 R; 15/236 R; 299/89; 299/41

[58] Field of Search ..... 15/93 R, 236 NO; 29/81 G, 81 J; 299/34, 41 B, 79, 89, 92; 30/276, 169, 170, 172, 347

[56] References Cited

U.S. PATENT DOCUMENTS

| | | | |
|---|---|---|---|
| 58,932 | 10/1866 | Wooten . | |
| 333,436 | 12/1885 | Wright . | |
| 1,090,646 | 3/1914 | Perkins . | |
| 1,239,480 | 9/1917 | Hardin . | |
| 1,282,285 | 10/1918 | Plank . | |
| 1,387,027 | 8/1921 | Watrous | 15/93 R X |
| 1,614,855 | 1/1927 | Stubblefield . | |
| 1,616,895 | 2/1927 | Grabowski . | |
| 1,653,108 | 12/1927 | Koenig . | |
| 1,721,266 | 7/1929 | Anderson . | |
| 1,777,677 | 10/1930 | Potter . | |
| 1,817,761 | 8/1931 | Potter . | |
| 1,877,269 | 9/1932 | Colgren . | |
| 1,903,877 | 4/1933 | Potter . | |
| 2,009,500 | 7/1935 | Kramer . | |
| 2,300,157 | 10/1942 | Hunt . | |
| 2,336,487 | 12/1943 | Lewis . | |
| 2,349,949 | 5/1944 | Farrell . | |
| 2,480,739 | 8/1949 | Johnson | 15/93 R |
| 2,489,399 | 11/1949 | Claytor . | |
| 2,504,643 | 4/1950 | Burgoon | 15/93 R |
| 2,642,272 | 6/1953 | Rush . | |
| 2,701,407 | 2/1955 | Jaques . | |
| 2,706,304 | 4/1955 | Demory | 15/93 R X |
| 2,734,498 | 2/1956 | VonArx . | |
| 2,738,966 | 3/1956 | Davis | 299/41 |
| 2,746,127 | 5/1956 | Jaques . | |
| 2,769,626 | 11/1956 | Becker . | |
| 2,786,322 | 3/1957 | McEvers | 30/276 X |
| 2,817,275 | 12/1957 | Lenker . | |
| 2,831,451 | 4/1958 | May . | |
| 2,862,224 | 12/1958 | Swansen et al. . | |
| 2,864,104 | 12/1958 | LeSage . | |
| 2,876,537 | 3/1959 | Bates . | |
| 3,028,152 | 4/1962 | Scholl | 15/93 R X |
| 3,061,860 | 11/1962 | Bennett . | |
| 3,094,047 | 6/1963 | Patton . | |
| 3,167,801 | 2/1965 | Engineer . | |
| 3,216,041 | 11/1965 | Walter . | |
| 3,289,297 | 12/1966 | Casselman . | |
| 3,343,883 | 9/1967 | Whittaker . | |
| 3,347,596 | 10/1967 | Brejcha . | |
| 3,361,044 | 1/1968 | Wolf . | |
| 3,418,762 | 12/1968 | Dooley . | |
| 3,468,583 | 9/1969 | Austin . | |
| 3,472,555 | 10/1969 | Theermann . | |
| 3,504,434 | 4/1970 | Thomsen . | |
| 3,517,463 | 6/1970 | Niemiec . | |
| 3,522,679 | 8/1970 | Sundberg . | |
| 3,544,075 | 12/1970 | Sugden | 299/34 X |
| 3,613,147 | 10/1971 | Norfleet | 15/236 NO |
| 3,678,532 | 7/1972 | Boyd . | |
| 3,739,442 | 6/1973 | Lovendahl . | |
| 3,754,297 | 8/1973 | Metz . | |
| 3,829,161 | 8/1974 | Wirtgen . | |
| 3,844,363 | 10/1974 | Williams . | |
| 4,137,595 | 2/1979 | Stewart | 15/93 R |

FOREIGN PATENT DOCUMENTS

| | | |
|---|---|---|
| 366013 | 1/1932 | United Kingdom . |

*Primary Examiner*—Gary L. Smith
*Attorney, Agent, or Firm*—Norman P. Friederichs

[57] ABSTRACT

A scarifying tool is disclosed suitable for use in conjunction with disc floor maintenance machines. The scarifying tool includes a support plate with a plurality of resilient or flexible members attached thereto. The flexible member may be lightweight spring-steel strap material one end of which is secured to a disc plate. A cutter is then mounted on the strap at a point spaced from the disc support.

23 Claims, 29 Drawing Figures

FIG. I
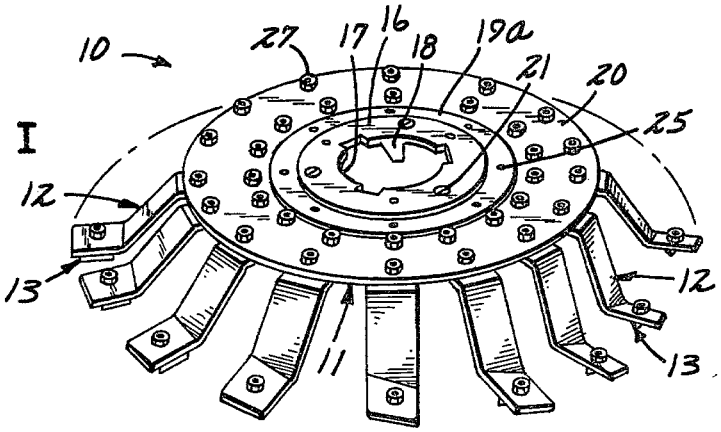
FIG. II
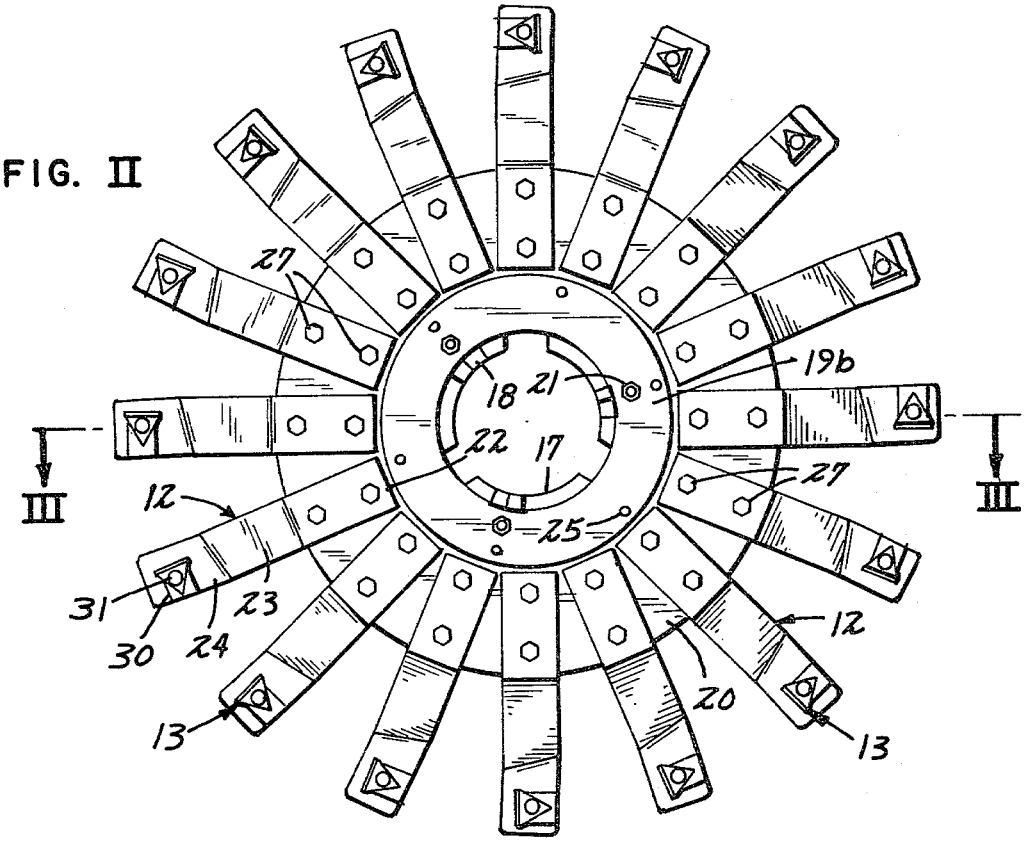
FIG. IV
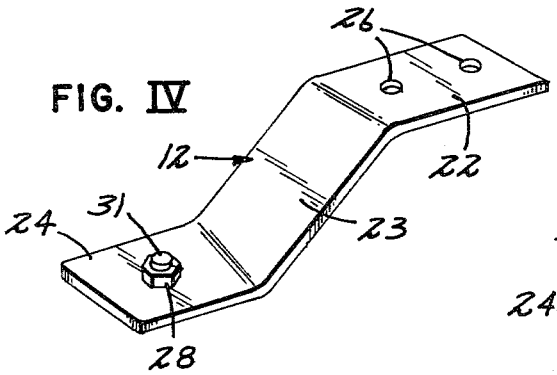
FIG. V
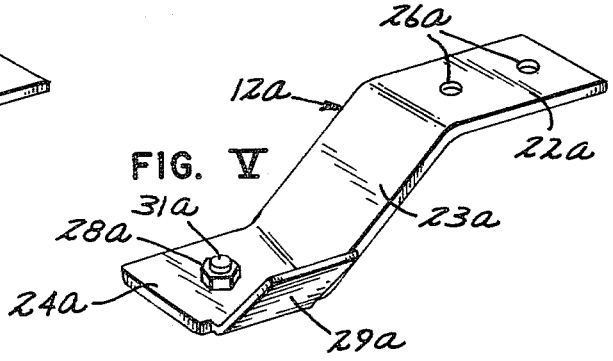

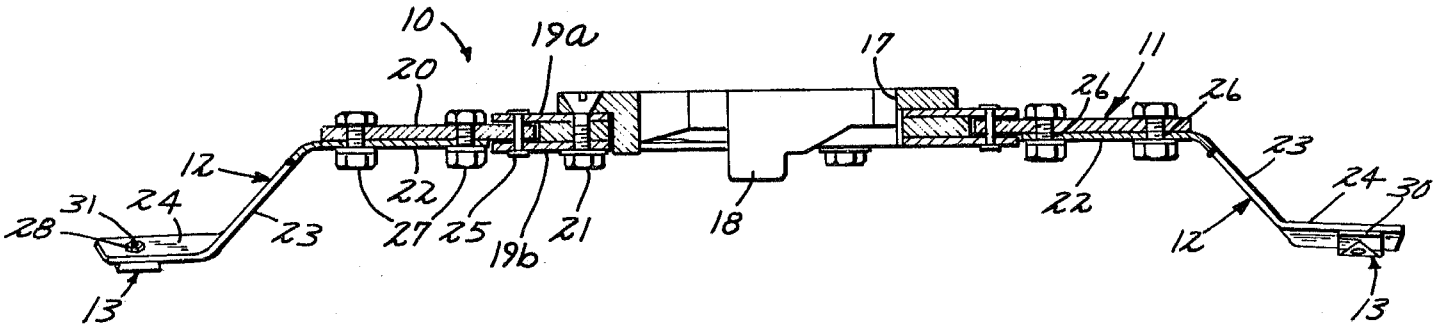
FIG. III
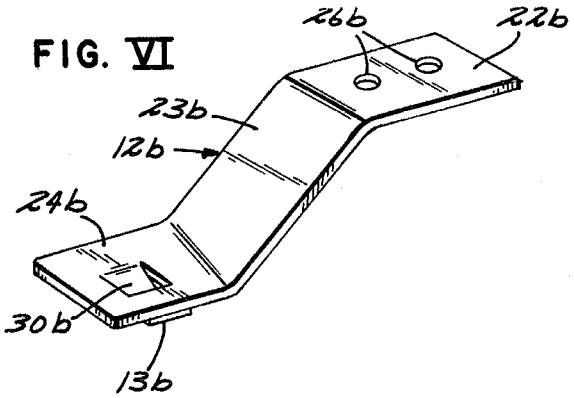
FIG. VI
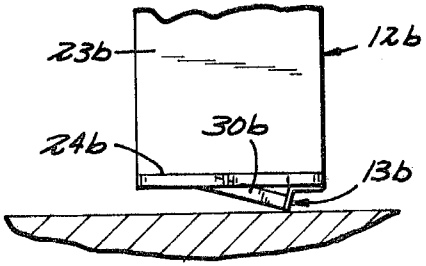
FIG. VII
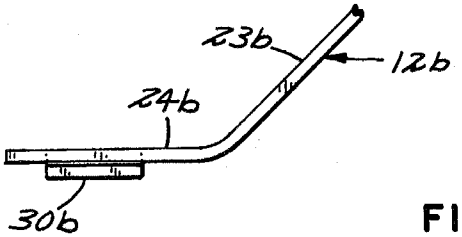
FIG. VIII

FIG. IX
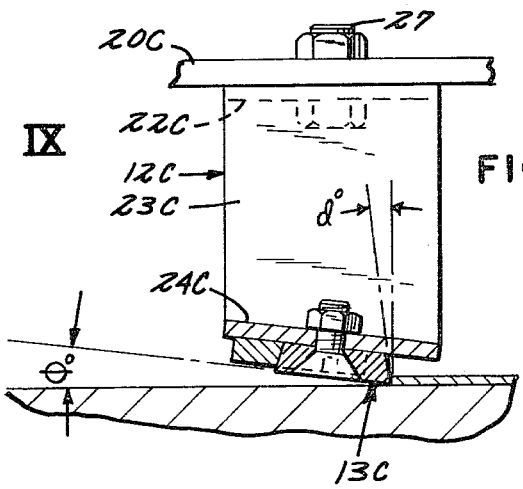
FIG. X
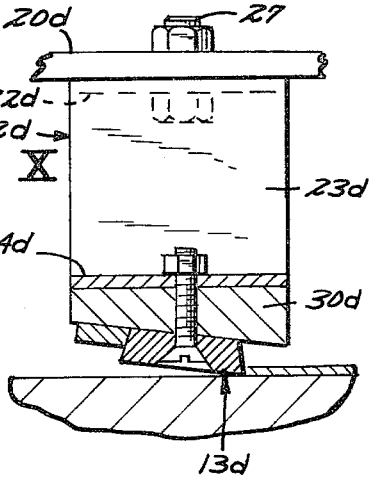
FIG. XI
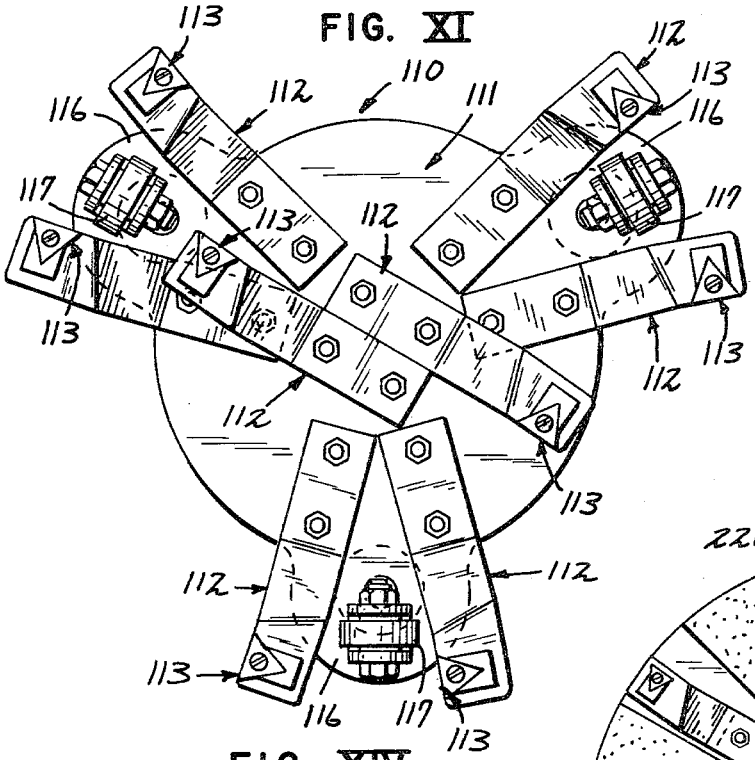
FIG. XII
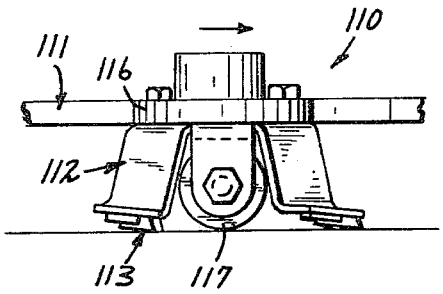
FIG. XIII
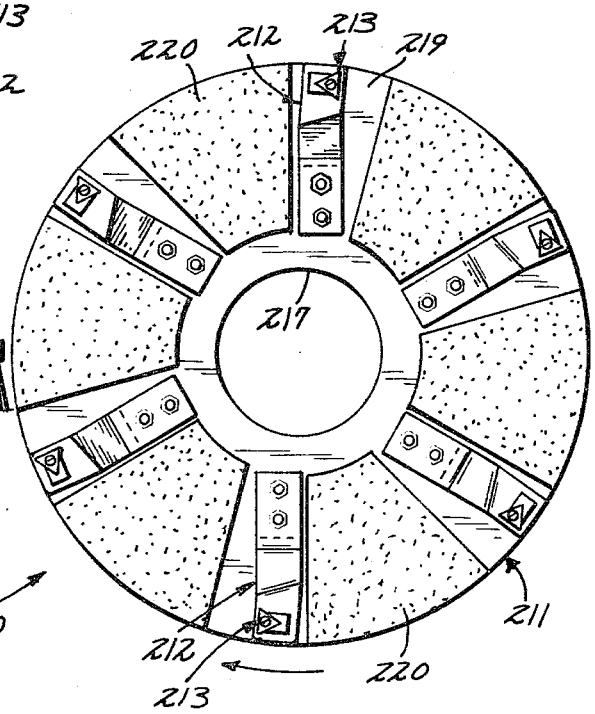
FIG. XIV
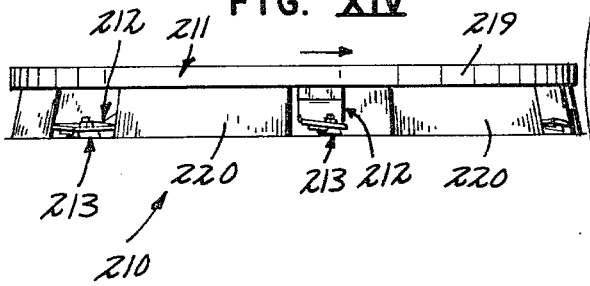

FIG. XV
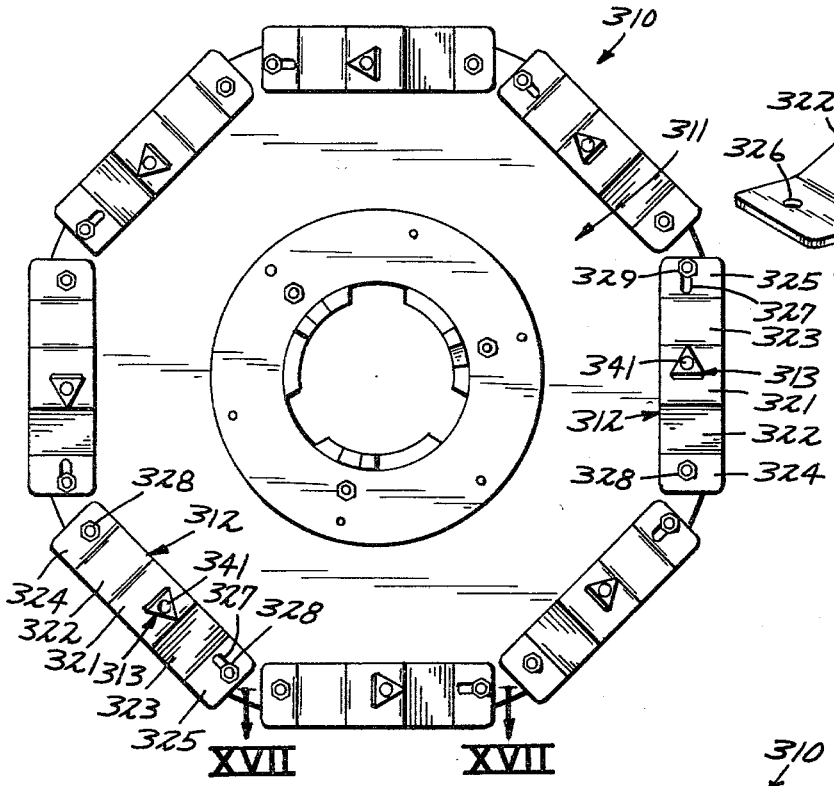
FIG. XVI
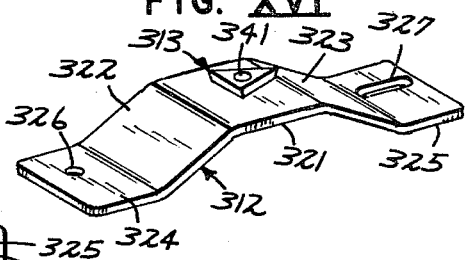
FIG. XVII
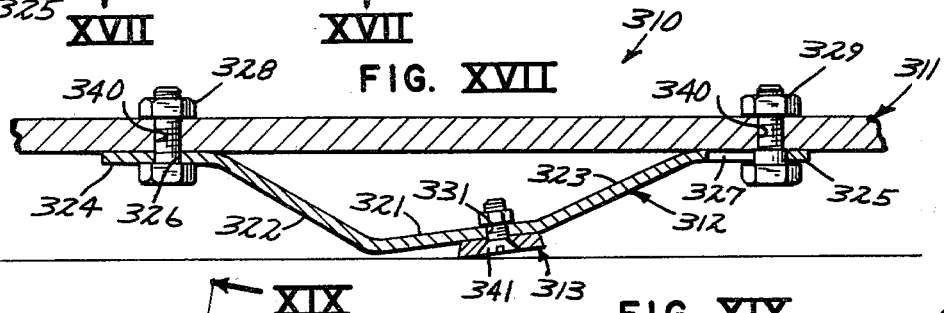
FIG. XVIII
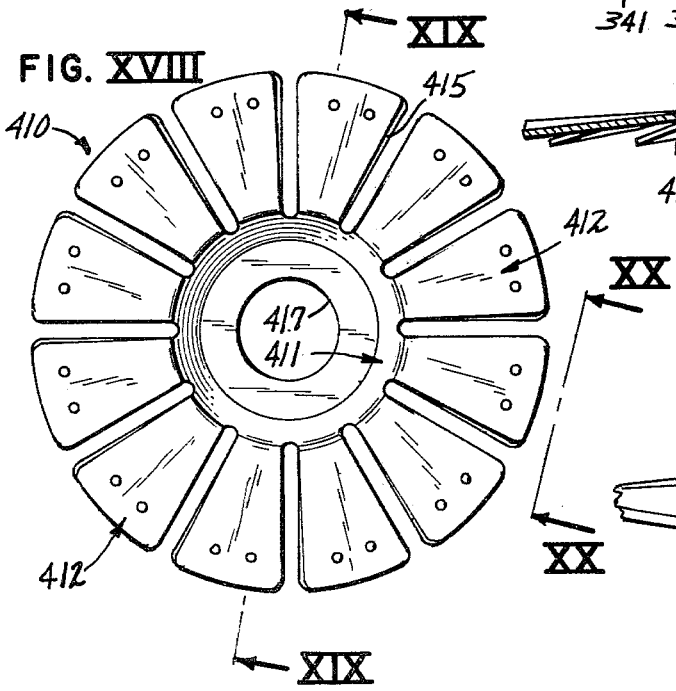
FIG. XIX
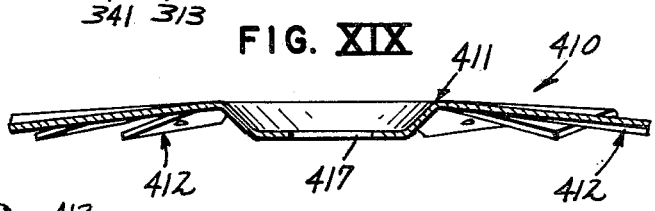
FIG. XX
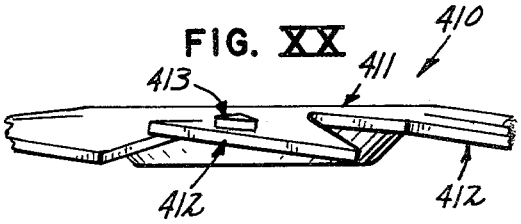

FIG. XXI
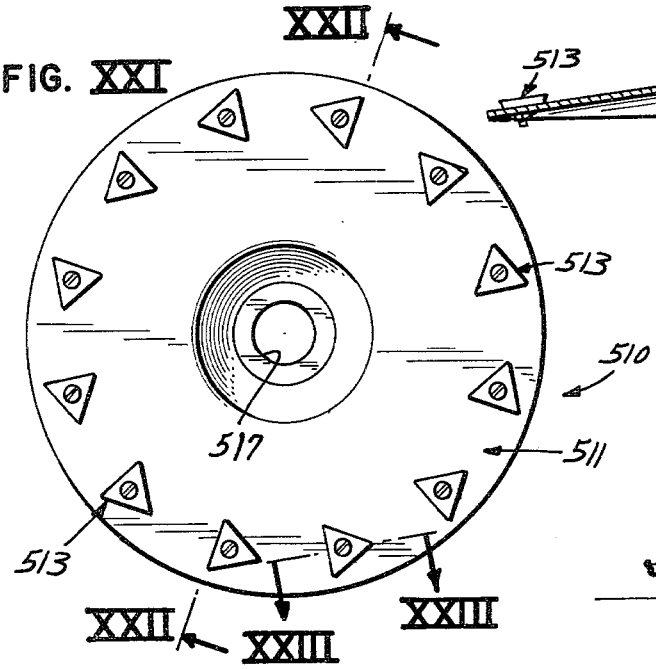
FIG. XXII
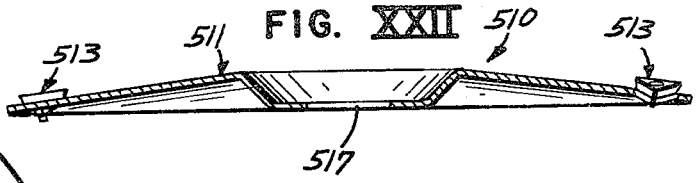
FIG. XXIII
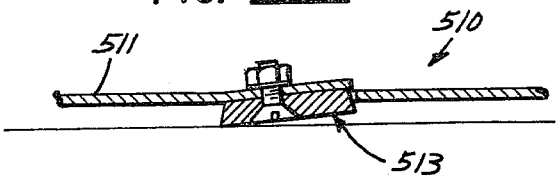
FIG. XXIV
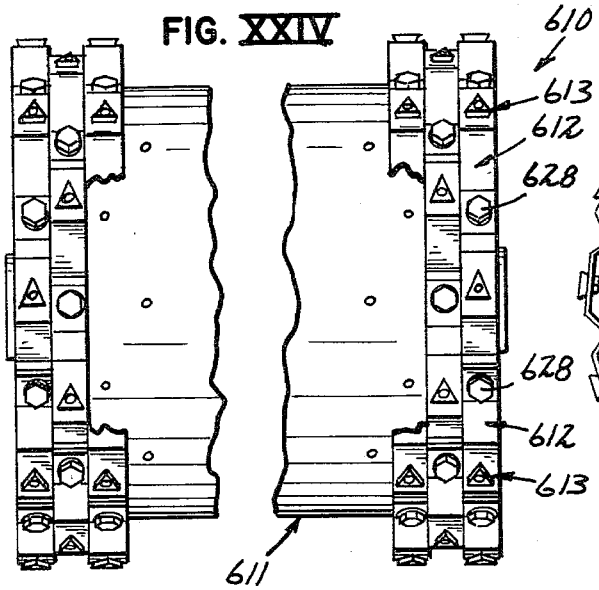
FIG. XXV
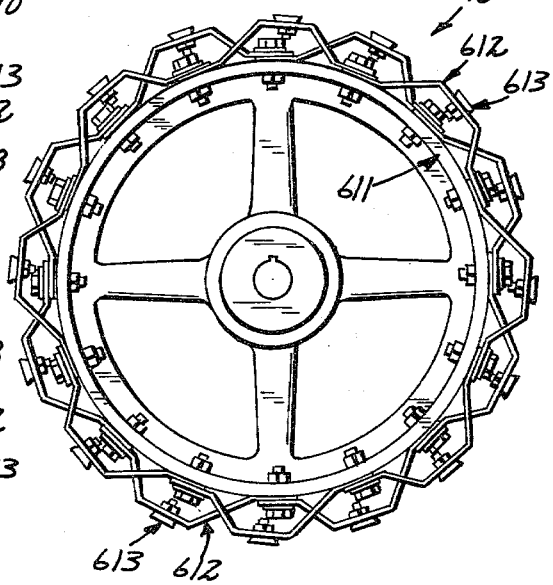
FIG. XXVI
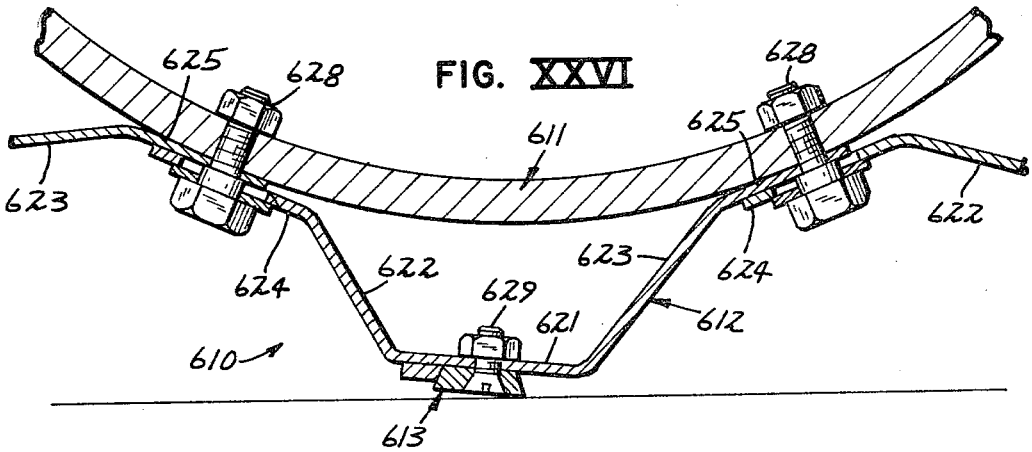

FIG. XXVII
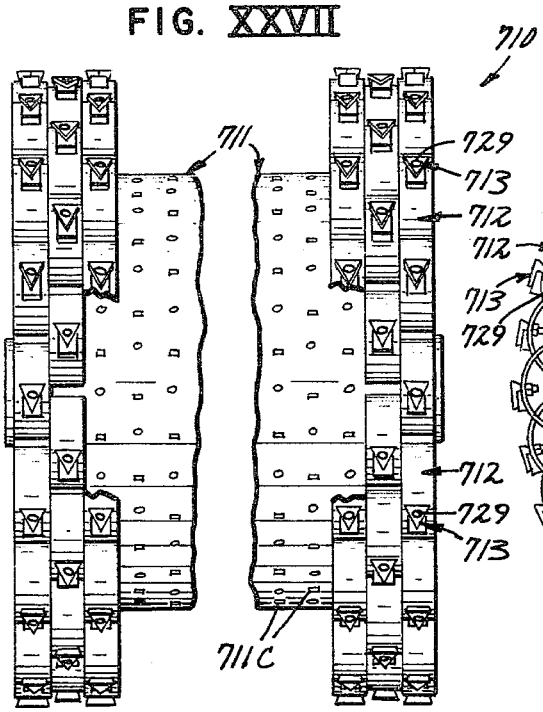
FIG. XXVIII
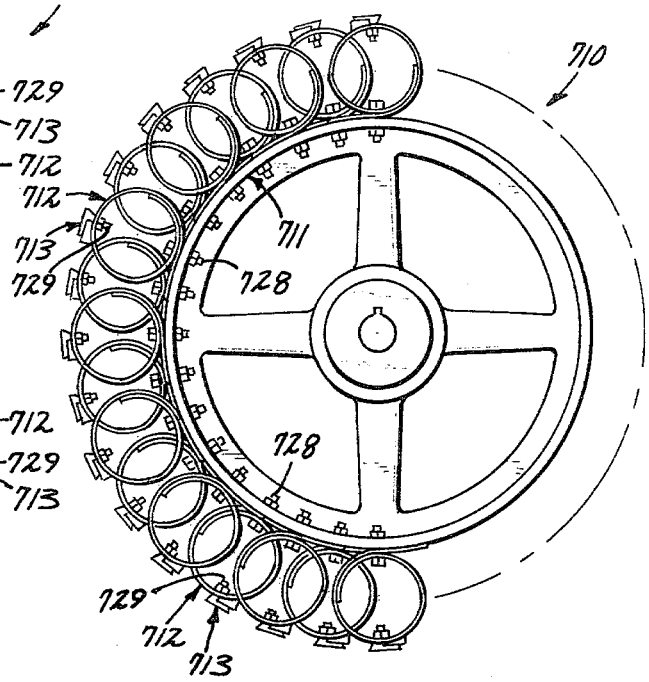
FIG. XXIX
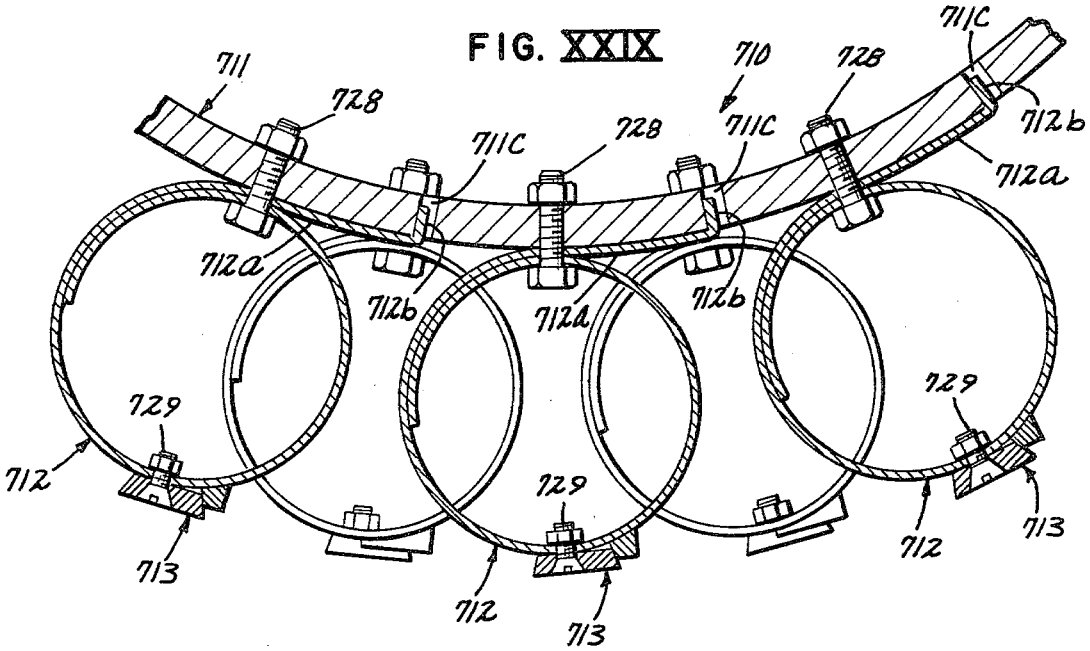

SCARIFYING MACHINE

BACKGROUND OF THE INVENTION

The present invention relates to scarifying machines and more particularly to scarifying machines which carry a plurality of cutters.

A long standing problem in industrial floor maintenance has been the removal of tough and gummy soilages as well as the removal of floor coating materials. Such materials typically include petroleum deposits, food residues, dust and other soil materials, spills, paints and plastic resins. Over the years, many methods have been employed for the removal of such materials. The methods have included the use of heavy duty powered round wire and butcher wire brushes, brushes with abrasive particles embedded in nylon bristles, automatic scrubbing machines which may use multiple soaking passes, open woven metallic sand papers, free abrasive scouring, light aggressive scarifying tools as well as harsh chemical removers that dissolve and suspend materials. The known methods have certain disadvantages. For example, the known methods generally require excessive amounts of power and may damage the surface of the floor. The known methods and equipment generally have high wear thus requiring frequent tool replacement. Also, the known methods generally require specialized machines which are not always available. Moreover, such known methods tend to be slow and inefficient. The chemical removers may require toxic chemicals and generally produce hazardous conditions on the floors due to the wet slippery nature. The known methods typically result in demanding and unpleasant work.

Previous methods for material removal have been of two general types, namely, the wet methods and the dry methods. The wet methods typically require application of highly alkaline or solvent based chemicals to soften, lift or dissolve the material. Illustrative of such solvent based chemicals is a commercially available product sold under the trademark Tennant 509. The chemical solvent is spread over the floor surface and allowed to react for a period of up to about one hour. Handscrapers are used to remove and collect the lifted material in the form of a wet sludge. The sludge is shoveled into drums for remote disposal at a site appropriate for disposal of hazardous materials. This process may be repeated to remove multiple layers of coatings. The surface may then be power sanded or dry abraded with an adrasive bristle brush. The surface is, subsequently, wet scrubbed.

The dry methods are illustrated by use of stiff wire brushes in such machines as the Tennant Models "R" and "K-4". Such equipment may use steel brushes or tools containing rows of hardened metal star-shaped washers to remove difficult soilage buildups and coatings. The dry methods would also include sand blasting or powered sanding techniques. U.S. Pat. No. 2,769,626 (Becker) shows a device for dry removing linoleum asphalt tile. The device has vertical removable flared tubing cutters around its periphery. U.S. Pat. No. 3,687,532 (Boyd) shows a disc device including many thin vertical discs attached around the periphery of the disc. U.S. Pat. No. 3,347,596 (Brejcha) shows a surfacing machine for terrazzo floors including rigidly held but removable cutting elements made of tungsten carbide. The cutting elements have negative axial rake that achieves longer tool life. The cutters cut through a surface contour to level or plane instead of following the surface in preparation for surface smoothing operation.

Illustrative of cylindrical tools used to remove a gummy or softened material from a permanent hard surface are disclosed in U.S. Pat. Nos. 1,616,895, 1,721,266 and 3,061,860. The known methods and tools are expensive and require large power sources, are slow and inefficient in their operation, have generally short lives, tend to clog with removed materials and often permanently scar or damage the floor surface.

The present invention overcomes those problems inherent in previous methods and tools. For example, a person removing material by hand-scraping can cover about 50 square feet per hour; whereas, a machine using the present tool may cover between 2500 and 3000 feet per hour. The present tool has a long life and is non-clogging. The present tool will cut through and scrape off gummy, softened materials and their interface with a permanent surface, such as a concrete floor, without causing damage to the permanent surface. The present tool is low in power consumption, is suitable for scraping off chemically treated, heated or otherwise softened coatings or grime and yet the operator is permitted to work on a safe dry surface. Use of the present tool permits use or selection of chemicals which are non-hazardous or do not result in disposal problems.

DESCRIPTION OF THE PRESENT INVENTION

The present invention relates to a tool for removing soilage and coatings from surfaces including a support which carries a plurality of flat springs, each of which have cutters mounted thereon. The basic support may be in the form of a plate disc. Alternatively, the support may be in the form of a hollow cylinder. The flat spring supports may be attached to the first support member in such a manner as to provide flexibility between the cutters and the basic support. The term "flat spring" as used herein refers to spring members made of strap metal shaped in various manners. The flat spring support may be cantilevered strap members, one end of which is attached to the first support member and the other end is attached to the cutter. The cutters may be carbide inserts of a triangular, rectangular, or square shape. The flat spring supports may alternatively be hat sections, one end of which is rigidly secured to the first support member and the other end is free for limited movement with respect to the first support member. Further, the flat spring supports may be in the shape of elliptical springs which are attached at one point to the first support member and have cutters attached at an opposite point on such springs.

IN THE DRAWINGS

FIG. I is a perspective view of one embodiment of the present invention;

FIG. II is a bottom plan view of the embodiment of FIG. I;

FIG. III is a cross-sectional view taken along the line III—III in FIG. II;

FIG. IV is an enlarged view of a cutter support spring and cutter of the embodiment of FIG. I;

FIG. V shows an alternative support spring and cutter;

FIG. VI is a perspective view of another alternative support spring and cutter;

FIG. VII is an end view of the support spring and cutter of FIG. VI;

FIG. VIII is a front view of the embodiment of FIG. VI;

FIG. IX is an end view of one support spring and cutter from FIG. II;

FIG. X is a view similar to FIG. IX, however, showing an alternative mounting arrangement for the cutter;

FIG. XI illustrates another embodiment of the present invention in which the tool includes roller supports;

FIG. XII is a fragmentary side view of the embodiment of FIG. XI;

FIG. XIII shows an embodiment of the present invention in which the tool includes brush structure;

FIG. XIV shows a side view of the embodiment of FIG. XIII;

FIG. XV shows an embodiment of the present invention in which the springs are of a hat-section strap support;

FIG. XVI is an enlarged perspective view of the strap support of FIG. XV;

FIG. XVII is a fragmentary side view of the embodiment of FIG. XV;

FIG. XVIII is a further embodiment of the present invention in which the strap spring supports are an integral portion of the basic support member;

FIG. XIX is a cross sectional view taken along the line XIX—XIX in FIG. XVIII;

FIG. XX is a fragmentary side view of the embodiment of FIG. XVIII taken along the line XX—XX;

FIG. XXI is a further embodiment of the present invention in which the cutters are supported on a flexible disc;

FIG. XXII is a cross sectional view taken along the line XXII—XXII in FIG. XXI;

FIG. XXIII is a fragmentary side view of the embodiment of FIG. XXI taken along the line XXIII—XXIII;

FIGS. XXIV through XXVI are views of embodiments of the present invention including a cylinder having hat-section straps supports mounted thereon; and FIGS. XXVII through XXIX are views of an embodiment in which the first support member is cylindrical in shape and the strap spring supports are in the form of loops with cutters mounted thereon.

DETAILED DESCRIPTION OF THE PRESENT INVENTION

The tool 10 of the present invention may be used in conjunction with any of various disc floor cleaning machines. The scarifying tool 10 (FIGS. I–III) may include a first support member or disc 11 and a plurality of radially extending flat support spring members 12, each of which carry at least one cutter blade 13. The disc support member 11 may include a clutch plate 16 suitable for engagement with the drive member of the floor machine and will generally include an open center portion 17 and suitable locking portion, such as 18, for engagement with the floor machine. The disc support member 11 includes a pair of backing plates 19*a* and 19*b*. The clutch plate 16 may be secured to the backing plates 19*a* and 19*b*, for example, by screws 21 thereby locking the clutch plate 16 with respect to the backing plates 19*a* and 19*b*. The tool 10 has a support plate 20 which is disposed between backing plates 19*a* and 19*b* and rotationally locked with respect to plates 19*a* and 19*b* by a plurality of rivet shear pins 25. The plates 16,19*a*, 19*b* and 20 may be constructed of any suitable materials such as steel plate. The rivet shear pins 25 may be of any soft metal such as aluminum.

The support spring 12 may be of a cantilever-type including an upper horizontal portion 22, a downwardly extending portion 23 and a lower horizontal portion 24 (see FIGS. I–IV). The upper portion 22 of spring 12 may have a pair of openings 26 defined therein for purposes of attaching the support spring 12 to the support plate 20, for example, using bolts 27 which extend through corresponding openings in member 11. The lower portion 24 may include an opening 28 for purposes hereinafter described. Flat support spring 12 may be fabricated from spring steel strap material of suitable thickness as shown FIG. IV. The lower portion 24 may be bent at the juncture with portion 23 so as to provide a slope with respect to the surface being worked (see FIG. IX). A plurality of such support springs 12 are provided around the circumference of the member 11.

FIG. V illustrates an alternative spring support 12*a* which includes an upper horizontal portion 22*a*, a downwardly extending portion 23*a* and a lower horizontal portion 24*a*. The structure and use of spring support 12*a* may be substantially the same as support 12; however, support 12*a* further includes an obstruction deflector portion 29*a* at the forward edge of portion 24*a*. The deflector portion 29*a* serves to spring the support 12*a* upwardly and over small obstructions which might otherwise permanently distort or break the support 12*a*.

The cutter 13 may be of any desired shape which provides a straight cutting edge. Cutter 13 is shown in FIG. II as being triangularly shaped. The cutter 13 may be square, hexigon or the like. In other words, the cutter 13 may have a plurality of cutting faces, any one of which may be faced forwardly in the cutting position. The cutter 13 may be attached to the spring support 12 such as by a screw 31 which extends through the opening 28 in leaf spring 12. A positioning member 30 may be provided between the support spring 12 and the carbide cutter 13 to provide orientation of cutter 13. The positioning member 30 may include a recess in which the cutter may be held thereby maintaining proper orientation of the cutter. In the instance of disc tools, as illustrated in FIGS. I–IV, the cutting edge of the cutter may lie along a ray extending from the center of the disc. The positioning member may be made integral with the spring suppot 12 such as by welding, brazing, or the like. The cutter may alternatively be held in proper orientation by providing a suitable recess in the spring support 12 e.g. by piercing or deforming the support 12. Orientation of the cutter 13 is important for proper removal of coating material without marring the surface being treated. As illustrated in FIG. IX, a relief angle$\theta$ is provided between the lower surface of cutter 13 and the surface being treated. The relief angle may vary depending on the use to which the tool is applied. The relief angle, for example, may be in the range of $\frac{1}{2}$ degree to 20 degrees. The rake angle may be in the range of from about $-10$ degrees to $+10$ degrees. The preferred relief angle is between $1\frac{1}{2}$ and 15 degrees. The preferred rake angle is between $-5$ and $+7$ degrees. It has been found that the optimum relief angle is between $1\frac{1}{2}$ and 3 degrees when removing soilage from a smooth coated concrete surface. The optimum relief angle for removal of soilage from a rough uncoated concrete surface is between 4 and 10 degrees; whereas, the optimum relief angle for removal of chemically softened coating from a smooth concrete surface is between 7 and 15 degrees. The rake angle d° is the angle between the cutting face of the cutter 13 and a line perpendicular to the surface being treated. The rake angle may vary depending on the particular surface being treated. The optimum rake angle for removing soiling from a smooth coated concrete surface is between 0 and +5. The optimum rake angle for removing soilage from a rough uncoated concrete surface is between −5° and +7°. The optimum rake angle for removing chemically softened coating from a smooth concrete surface is between −5° and +5°. The cutters may be made of any of various materials such as tungsten carbide, acetal polymer, (Delrin TM) and polycarbonate (Laxan TM) as well as tool steel.

The cutter 13 may be mounted in any of various ways in order to provide proper rake and relief angles. FIGS. VI–VIII illustrate a spring support **12*b* having a lower horizontal portion 24*b* with a pierced zone 30*b* provided with a cutting edge such as plasma coated cutting surface 13*b*. The zone 30*b* is sloped with respect to the floor surface whereas the remainder of horizontal portion 24*b* is substantially parallel with the floor surface. The slope of zone 30*b*** provides the desired relief angle.

FIG. IX shows a spring support **12*c* with an entire lower horizontal portion 24*c* which is sloped with respect to the floor surface. The slope of horizontal portion 24*c* provides the desired relief angle for the cutter 13*c***.

FIG. X shows a spring support **12*d* having a lower horizontal portion 24*d* which is parallel with the surface being treated. A positioning member 30*d* is provided between the cutter 13*d* and horizontal portion 24*d*** thereby producing the desired relief angle.

An alternative tool 110, illustrated in FIGS. XI and XII, is adapted for use in conjunction with terrazzo machines. The tool 110 may be somewhat similar to tool 10 including a backing plate 111 with a plurality of radially extending support springs 112, each of which carry a cutter 113. The support springs 112 and cutters 113 as well as their attachment may be as described with regard to tool 10. The backing plate 111 may include a plurality of lobes 116 each of which carry a roller 117 which is to limit the pressure applied to the support springs 112 and cutters 113. In other words, a portion of the weight of the backing plate and the terrazzo machine is supported on the rollers 117. The upper surface of the backing plate 111 may be suitably adapted for attachment to the terrazzo machine.

The tool 210 shown in FIGS. XIII and XIV include the combination of a plurality of cantilevered flat support springs 212 with cutters 213 and an abrasive bristle disc brush 211. The bristle disc brush 211 may include a wooden backing disc 219 and a plurality of bristle zones 220. The tool 210 includes a pilot hole 217 and is adapted for standard clutch plates.

A further embodiment 310 of the present invention is shown in FIGS. XV through XVII. The tool 310 may include a plate 311 which is very similar in structure to plate 11 of FIG. I. Tool 310, however, has a plurality of hat section flat spring supports 312. The hat spring supports 312, as shown in FIG. XVI, may include a lower near-horizontal portion 321, a pair of upwardly extending portions 322 and 323, and a pair of laterally extending portions 324 and 325. The portion 321 adjacent the juncture of portion 321 and 322 clears the surface being treated, for example, by about 1/16 inch when in use. The portion 324 has an opening 326 defined therein and portion 325 has a slot shaped opening 327 defined therein. The spring support 312 may be secured to the plate 311 by a screw or bolt 328 which extends through opening 326 for threaded engagement in a suitable opening 340 in plate 311. The portion 325 of spring support 312 is secured to plate 311 for limited movement with respect thereto, for example, by extending a shoulder bolt 329 through the slot opening 327 for engagement in the plate 311. Portion 321 of spring support 312 may include an opening 331 to facilitate attachment of the cutter 313 such as by use of screw 341.

Another embodiment of the present invention, tool 410 is illustrated in FIGS. XVIII through XX. In this instance, the disc portion 411 and the radially extending flat spring portions 412 are integral. In other words, the tool may be cut from a single resilient disc with a plurality of radially inwardly extending slots 415 defined therein thereby providing the spring support member 412 intermediate such slots. A cutter 413 may be secured to each of the spring members 412 in the manner previously described. The tool 410 may include a central opening 417 and is suitable for attachment to a machine.

The tool 510 (FIGS. XXI–XXIII) has a disc support portion 511, the outer portion of which is flexible (i.e. of spring steel) and serves as a spring support for the cutters 513. The tool 510 may include a central opening portion 517 and is adapted for attachment to a disc machine.

The present invention may be applied to various other types of machines, for example, as illustrated in FIGS. XXIV through XXVI, the present invention may be in the form of a cylindrical tool. For example, the tool 610 may include a cylindrical first member 611 with a plurality of hat section spring supports 612 mounted thereon. The hat section spring supports may extend substantially the full width of the cylinder member 611 and include a lower horizontal portion 621, a pair of upwardly extending portions 622 and 623 and a pair of tangential portions 624 and 625. The hat section spring members may be suitable secured to the cylinder 611 such as by shoulder bolt 628 in such a manner that one edge of the spring support 612 (e.g. portion 625) is locked with respect to cylinder 611 by the shoulder bolt 628, whereas, the other portion 624 is permitted to move somewhat with respect to the shoulder bolt 628. The spring support 612 carries a cutter 613 which is secured to spring support 612 by screw 629. The tool 610, if desired, may include brush bristles or paddles in a manner similar to tool 210.

Tool 710 (FIG. XI) includes a drum portion 711, a plurality of spring supports 712 carrying a plurality of cutters 713. In this instance, the spring support member 712 may be in the form of a resilient loop which attach to cylinder 711 by a bolt 728. Flat spring support 712 may have a stabilizing flange **712*a* with a locking tip 712*b* which rests in a slot 711*c* in drum 711. The spring supports 712 may alternatively be held in place by locating the support 712 partially within a recess in the drum 711 such by using a corrugated drum. The cutter 713 may be secured to the spring support 712 by screw 729**.

The tool of the present invention may be used on various commercially available machines. The tools 10, 210 and 310 may be used on conventional hand operated floor buffing machines. The tools 10, 210 and 310 are also suitable for use on walk behind or rider floor auto disc scrubbers. The tools 410 and 510 may be used on typical hand held sanding or grinding machines, as well as, on hand held edging machines. The tool 110 may be used on floor finishing or terrazzo machines. The tools 610 and 710 may be used on walk behind or rider surface scarifier machines.

Although several preferred embodiments of the present invention have been disclosed herein, it is to be recognized that various modifications may be made without departing from the broader scope of the present invention. For example, cantilever type spring supports, hat section type spring supports and oval type spring supports have been specifically illustrated but it is to be recognized that other types of spring supports may alternatively be used. The flat spring supports may each carry a single cutter or a plurality of cutters.

What is claimed is:

1. A tool suitable for removing built-up layers of soilage or coatings from surfaces, said tool comprising:

first support means adapted for attachment to a rotary power machine;

second support means mounted on said first support means, said second support means comprising a multiplicity of radially-extending elongated resilient spring members; and removable cutter means mounted on said second support means;

said first support means, second support means and cutter means in combination serving to at least partially support said rotary power machine on said surface, said cutter means being resiliently supported with respect to said first support means by said second support means.

2. The tool of claim 1 wherein said first support means comprise a disc structure.

3. The tool of claim 1 wherein said second support means comprise a strap spring member and wherein said strap spring member includes means providing sloped mounting of said cutter means thereby producing a relief angle for said cutter.

4. The tool of claim 1 wherein said second support means comprise a cantilever strap member and wherein said strap spring member includes means providing sloped mounting of said cutter means thereby producing a relief angle for said cutter.

5. A tool for removing soilage or coatings, said tool comprising:

support means including means for attaching said tool to a rotary driving machine, backing plate means and support plate means, said attaching means being locked with respect to said backing plate means and said support plate means being releasibly locked with respect to said backing plate means by shear means;

flat spring means secured to said support plate means; and cutter means secured to said flat spring means, said cutter means being resiliently supported by said spring means with respect to said backing plate means.

6. The tool of claim 5 wherein said support plate means is locked with respect to said backing plate means by replaceable shear pin means.

7. The tool of claim 5 wherein said flat spring means comprise a plurality of radially-extending cantilever strap spring means, each of said cantilever means carrying at least one of said cutter means.

8. A tool for removing soilage or coatings, said tool comprising:

a multiplicity of flat spring members and removable cutter means mounted on said flat spring members;

support means extending radially outwardly including plate means; said flat spring members being mounted on said plate means extending radially outwardly thereby resiliently supporting said cutter means with respect to said plate means, said flat spring members and said cutter means in combination being adapted to support said tool on a surface from which said soilage or coatings are being removed.

9. The tool of claim 8 wherein said plate means comprise a disc-like plate member.

10. The tool of claim 8 wherein said cutter means comprise a cutter having a forwardly facing straight cutting edge.

11. The tool of claim 10 wherein said cutting means comprise carbide cutters.

12. The tool of claim 10 wherein said cutter has a plurality of straight cutting edges.

13. The tool of claim 12 wherein said cutter is triangularly shaped to provide a plurality of cutting edges.

14. The tool of claim 12 wherein said tool includes a positioning member, said member being secured to said flat spring means and said member serving to lock said cutter in cutting position.

15. The tool of claim 12 wherein said flat spring means includes a recess and wherein a portion of said cutter lies in said recess, said recess serving to lock said cutter in cutting position.

16. A tool for removing soilage or coatings, said tool comprising:

flat spring means and cutter means mounted on said flat spring means;

support means including plate means, said flat spring means being mounted on said plate means extending radially outwardly thereby resiliently supporting said cutter means with respect to said plate means, said cutter means having a relief angle in the range of from $\frac{1}{2}$ to 20 degrees.

17. A tool for removing soilage or coatings, said tool comprising:

flat spring means and cutter means mounted on said flat spring means;

support means including plate means, said flat spring means being mounted on said plate means extending radially outwardly thereby resiliently supporting said cutter means with respect to said plate means, said cutter means having a rake angle of from $-10$ to $+10$ degrees.

18. A tool for removing soilage or coatings, said tool comprising:

flat spring means and cutter means mounted on said flat spring means;

support means including plate means, said flat spring means being mounted on said plate means extending radially outwardly thereby resiliently supporting said cutter means with respect to said plate means, said cutter means having a relief angle of between $1\frac{1}{2}$ and 15 degrees.

19. A tool for removing soilage or coatings, said tool comprising:

flat spring means and cutter means mounted on said flat spring means;

support means including plate means, said flat spring means being mounted on said plate means extending radially outwardly thereby resiliently supporting said cutter means with respect to said plate means, said cutter means having a rake angle of between −5 and +7 degrees.

20. A tool for removing soilage or coatings, said tool comprising:

flat spring means and cutter means mounted on said flat spring means;

support means including plate means, said flat spring means being mounted on said plate means extending radially outwardly thereby resiliently supporting said cutter means with respect to said plate means, said flat spring means comprising a plurality of cantilever flat spring members, each of said members including an obstruction deflector.

21. A tool for removing soilage or coatings, said tool comprising:

flat spring means and cutter means mounted on said flat spring means;

support means including plate means, said flat spring means being mounted on said plate means extending radially outwardly thereby resiliently supporting said cutting means with respect to said plate means, said flat spring means comprising a plurality of cantilever flat spring members, each of said members including a sloped portion for providing proper relief angle for said cutter.

22. A tool for removing soilage or coatings, said tool comprising:

support means including plate means;

a plurality of cantilever flat spring members mounted on said plate means, each of said spring members including an obstruction deflector; and cutter means mounted on each of said spring members, said cutter means each including a forwardly facing substantially straight cutting edge whereby said cutter means are resiliently supported with respect to said plate means by said spring members.

23. A tool for removing soilage or coatings, said tool comprising:

support means including plate means;

a plurality of cantilever flat spring members mounted at one ebd on said plate means;

a positioning member secured to each flat spring member at the other end thereof; and cutter means mounted on said other end of said spring members, said cutter means including a forwardly facing substantially straight cutting edge being along a ray extending from the center of said plate means, said positioning member serving to orient said cutter means to a relief angle of between ½ and 20 degrees and a rake angle of between −10° and +10°.

* * * * *